United States Patent [19]

Liu

[11] Patent Number: 5,001,793

[45] Date of Patent: Mar. 26, 1991

[54] VERTICALLY ACTUATED ARRAY OF MATTRESS VALVES

[76] Inventor: Yiu-Ching Liu, 973 Shulman Ave., Santa Clara, Calif. 95050

[21] Appl. No.: 530,217

[22] Filed: May 30, 1990

[51] Int. Cl.[5] ..... A47C 27/10

[52] U.S. Cl. ..... 5/455; 5/449; 5/468

[58] Field of Search ..... 5/453, 449, 450, 454, 5/455, 456, 457, 458, 468, 469; 297/DIG. 3

[56] References Cited

U.S. PATENT DOCUMENTS

| | | | |
|---|---|---|---|
| 1,266,482 | 5/1918 | Kamrass | 5/450 |
| 3,739,407 | 6/1973 | Stiller | 5/457 |
| 3,740,777 | 6/1973 | Dee . | |
| 3,818,522 | 6/1974 | Schuster | 5/468 |
| 3,942,202 | 3/1976 | Chevrolet . | |
| 4,279,044 | 7/1981 | Douglas | 5/453 |
| 4,485,505 | 12/1984 | Paul | 5/453 |
| 4,631,767 | 12/1986 | Carr et al. | 5/449 |
| 4,766,629 | 8/1988 | Schueler | 5/451 |
| 4,799,276 | 1/1989 | Kadish | 5/446 |

*Primary Examiner*—Alexander Grosz
*Attorney, Agent, or Firm*—Schneck & McHugh

[57] ABSTRACT

A body support device having a gas inlet to receive a supply of pressurized air and having a plurality of gas outlets in fluid communication with the gas inlet. The outlets are orifices at the upper surface of the support device. The support device may be an inflatable mattress, cushion or the like. A plurality of valves are attached to the support device at the orifices and are biased into positions to obstruct gas flow through the orifices. Vertically displaceable members extend to a level with respect to the upper wall of the support device such that a force applied to the upper wall about a member urges the member downward. The vertically displaceable members are mutually independent, but each one is in motion-transfer engagement with one of the valves to independently move the valve into a gas-release position upon downward movement of the displaceable member. In a preferred embodiment, the displaceable members are hammers having downwardly extending projections in contact with the associated valve.

17 Claims, 2 Drawing Sheets

5

VERTICALLY ACTUATED ARRAY OF MATTRESS VALVES

TECHNICAL FIELD

The present invention relates generally to cushions, mattresses, and the like, and more particularly to inflatable devices which allow gas flow in the direction of a person.

BACKGROUND ART

U.S. Pat. No. 4,631,767 to Carr et al. describes an air flotation mattress for the treatment of bedridden patients. The patent teaches that conventional mattresses obstruct both the flow of air to the skin of a patient and the dissipation of heat away from the areas of the patient's skin in contact with the mattress. Moreover, decubitus ulcers, commonly referred to as bed sores, develop as a result of the combination of heat, moisture, pressure and shear forces on the body areas in contact with the mattress. The occurrence of decubitus ulcers is reduced by use of a highly deformable mattress, such as a water-containing mattress, but high local pressure still exists in the deformed tissue of the patient to compress blood vessels and to cause tissue damage.

Improvements in the treatment of bedridden persons have been provided by use of air mattresses as described in Carr et al. An air mattress allows continuous air flow through the mattress to provide ventilation for of the patient's skin. The ventilation facilitates moisture dissipation and acts as an insulator to avoid skin abrasion. Since shearing force, heat, moisture and abrasion are leading causes of decubitus ulcers, the air mattress significantly reduces the risk of formation of tissue damage. Other such air mattresses are described in U.S. Pat. Nos. 3,740,777 to Dee, 4,279,044 to Douglas, 4,485,505 to Paul, and 4,766,629 to Schueler.

Another device for increasing the comfort of a bedridden person is described in U.S. Pat. No. 4,799,276 to Kadish. The patent describes a bed having a matrix of supports in the form of free-floating, pressurized, air-supported pistons. The pressure exerted by a patient's body sections against individual support systems is constantly measured. Valves control the discharge of the air from the piston chambers of the individual support pistons, so that after a preset time and level of pressure prevailing within a given piston chamber, a fixed amount of air is discharged. The discharge of air causes the support system to move downwardly to allow a change in the position of the patient. At the end of a cycle, all of the pistons are brought back to their initial high level.

One problem with the air-release mattresses described above, is that the constant air flow requires a high volume of air to be channeled into the mattress. Thus, the blower must be a high-volume pump which is typically more expensive and more noise-generating than a pump which is not required to move a high volume of air. The matrix of support systems which are individually valved to automatically reposition a patient after a preset period of time, as taught by Kadish, overcomes this requirement of a high-volume pump. However, Kadish requires a microprocessor controller or the like to constantly monitor the individual support systems. The device is not an inexpensive one.

U.S. Pat. No. 3,942,202 to Chevrolet teaches an air support mattress which reduces the volume of air necessary for providing a mattress having an array of vents to direct air at a patient. Each vent of the Chevrolet mattress includes a pair of lips which meet tangentially to normally block air flow through the vent. When a person lies on the mattress, the weight of the person pulls the lips apart to allow a stream of air to flow through the vents and exert a supporting force on the body part depressed on the mattress. That is, an unoccupied mattress does not include a flow of air through the upper wall of the mattress, but upon deformation of the mattress, air flow is initiated. While the force applied to the mattress is a vertical force provided by the weight of the person, the separation of the lips requires a horizontal component of force. Because the lips are separated horizontally and because the mattress is made of material which readily deforms, individual vents are opened even when located at a distance from the patient that guarantees that no air released from the vent will come in contact with the patient. Depending on the material used in the manufacture of the mattress, it is possible that each vent of the mattress will be opened by the weight of a patient, thereby offering no improvement over the high-volume requirements of the prior art.

It is an object of the present invention to provide a body support device having an upward release of gas wherein the release is selectively localized. It is a further object to provide such a device which consumes less power and produces less noise than the prior art without an increase in cost of the device.

SUMMARY OF THE INVENTION

The above objects have been met by an inflatable, balloon-like support member having a gas inlet and an upper wall having a plurality of gas outlets in fluid communication with the gas inlet to selectively permit gas flow therethrough. Gas flow through each gas outlet is individually valved. The valving action requires a force having a vertical component, thereby preventing the triggering of valves which are distant from the body of the user.

The gas outlets make up an array of orifices in the upper wall of the support member. Each orifice includes a reciprocating flap which is pivotally attached to the upper wall. The flap has a gas-release position in which a portion of a flap is spaced apart from the upper wall to prevent gas flow through the associated orifice, In a closed position, a flap is brought into sealing relation with the upper wall to block gas flow through the orifice. The material which pivotally connects the flaps to the upper wall has a memory which biases the flaps into the closed position. Moreover, gas pressure within the inflatable support member urges the flaps into the closed position.

Vertically displaceable members are in motion-transfer engagement with the flaps. The displaceable members are mutually independent with respect to vertical displacement. Typically, the displaceable members extend to a level with respect to the upper wall such that a force applied to the upper walla bout an individual orifice downwardly presses the displaceable member operatively associated with that orifice and its flap. Downward movement of a displaceable member opens the associated flap to a gas-release position.

In a preferred embodiment, the displaceable members are hammers having fixed ends attached to the upper wall and having cantilevered ends in contact with the flaps. The cantilevered ends have rest positions extending to a level above the upper wall. Thus, a mass in contact with the upper wall about the cantilevered end applied a force upon a hammer to overcome the bias of the flap into the gas-release position. A second embodiment has a unitary member which combines the flap and the displaceable member. In this embodiment, the flap is a circular member having an upwardly extending projection. A person resting on the support member comes into contact with a plurality of the projections to press the flaps into a gas-release position.

A third embodiment of the present invention includes a cover having a plurality of downwardly extending nodules. The nodules act as the vertically displaceable members. A person resting upon the cover causes nodules to overcome the bias of the flaps beneath the person, thereby allowing the escape of gas, typically air.

An advantage of the present invention is that a force having a vertical component is required for opening of a gas outlet. Thus, gas outlets which are not in the immediate vicinity of an occupant remain in a sealed condition. Because only selected gas outlets allow passage of air, a low-volume pump is sufficient to operate the body support device. A low-volume pump is less expensive and typically less noisy than its high-volume counterpart. Another advantage of the present invention is that, unlike an electric blanket, the occupant is not surrounded by a device which requires alternating current.

BEST MODE FOR CARRYING OUT THE INVENTION

Figure 1:
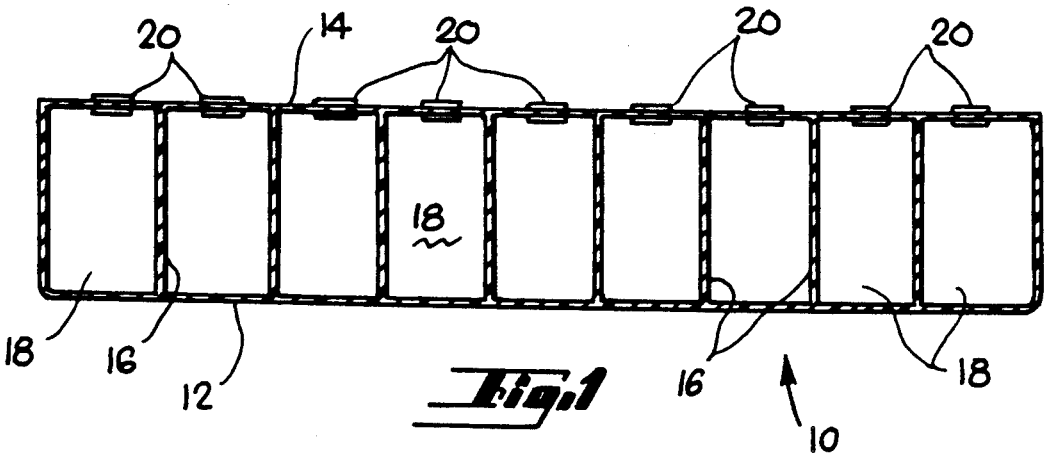
FIG. 1 is an end sectional view of an air mattress in accord with the present invention.

With reference to FIG. 1, an air mattress 10 includes an upper wall 14, a lower wall 12 and a number of ribs 16. The ribs 16 separate the volume of the air mattress 10 into a plurality of segments 18. Segmenting the air mattress aids in providing a more uniform support of a person.

Each segment 18 of the air mattress 10 is in fluid communication with a supply of gas, not shown. Typically, air is used to pressurize the segments 18. The material for constructing the air mattress 10 is an air-impermeable material having an elasticity which allows compression of the mattress by the mass of an occupant. While the mattress will be described as suitable for a bed, the present invention may be used in the construction of seat cushions and other devices used in supporting the body for an extended period of time.

Figure 3:
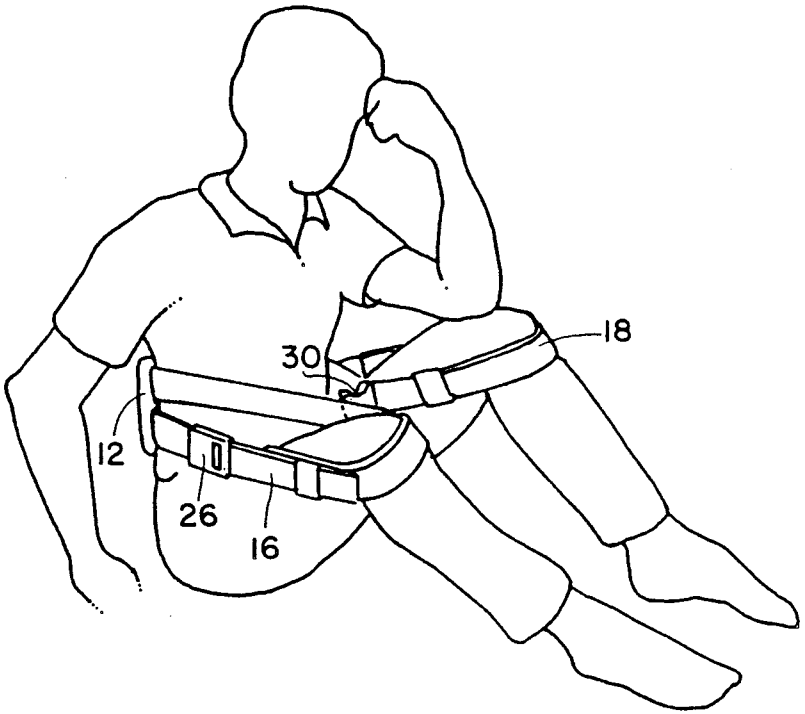
FIG. 3 is a side sectional view of the valve of FIG. 2 taken along lines 3—3.
Figure 2:
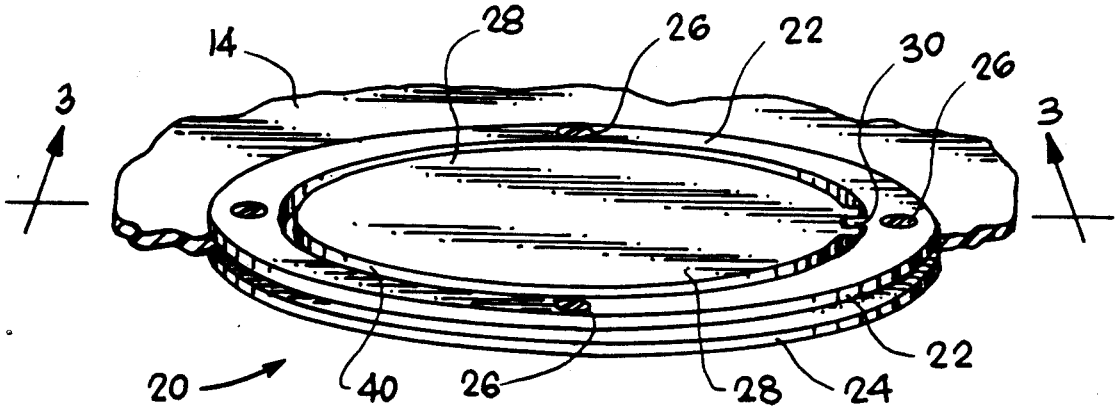
FIG. 2 is a perspective view of the preferred embodiment of a valve of a mattress of FIG. 1.
Figure 3:
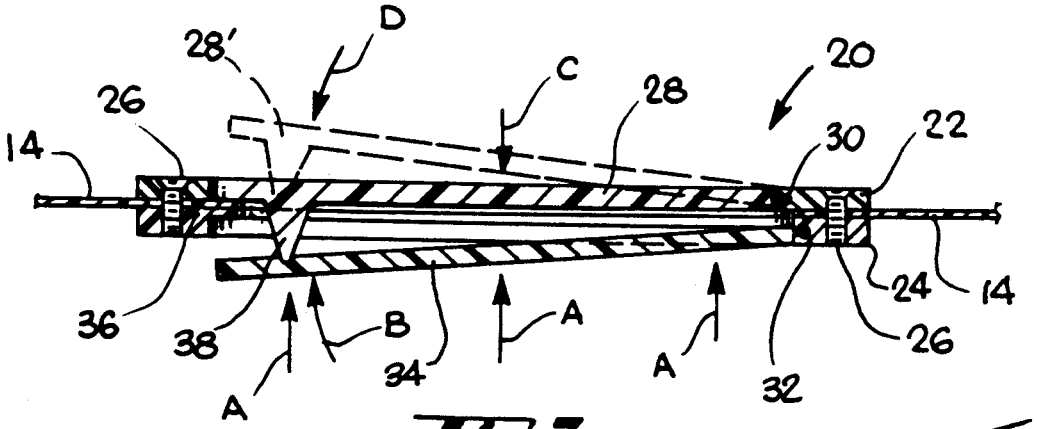
Figure 4:
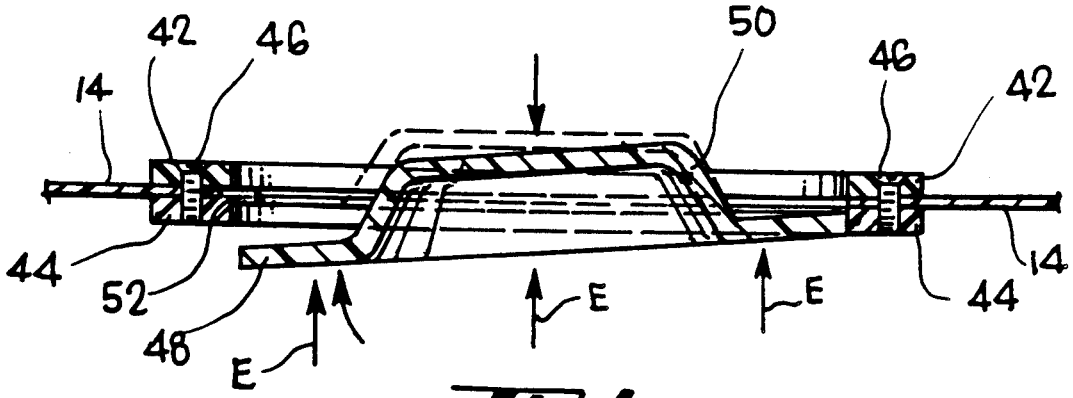

Now referring to FIGS. 1–3, each segment 18 of the air mattress 10 includes an array of valved gas outlets 20 in the upper wall 14. The valved gas outlets selectively release air from the segments 18 to aid in the support of a person and to provide a jet of air for the comfort of a person. While use is not limited to bedridden persons, the flow of air from the mattress 10 reduces the shearing force experienced by a person lying on top of a bed. Shearing force would otherwise stress tissue, causing damage to the tissue. Moreover, the flow of air provides cooling and reduces perspiration.

Each valved gas outlet 20 includes a top ring 22 and a bottom ring 24. The upper wall 14 of the air mattress 10 has a plurality of apertures symmetrically disposed to receive externally-threaded flathead screws 26. Preferably, the flathead screws 26 are made of nylon. The screws extend through the top ring 22 and are fastened to internally-threaded holes in the bottom ring 24 to fix the rings to the upper wall 14 of the air mattress.

The top ring 22 is connected to a hammer member 28 at a hinge 30. The hinge 30 may be a pin which defines a pivot axis as shown in FIG. 3. Alternatively, the top ring 22 and the hammer member 28 may be a unitary body in which the hammer member is made up of material having an elasticity which allows flexure at the hinged region 30.

The bottom ring 24 likewise includes a hinge 32. The hinge 32 of the bottom ring secures a flap 34 which acts as a seal. Like the structure described above, the bottom ring maY be part of a unitary bodY which includes the flap 34. It is also possible to attach the hammer member 28 and attach the flap 34 to the associated rings 22 and 24 via other means. For example, the hammer member and the flap may be secured by an adhesive or may be secured by spot-melting of materials. It is also possible to fix the hammer member 28 and/or the flap 34 directly to the upper wall 14 of the air mattress 10. In any case, however, the hammer member and the flap must be allowed to move from the lowered, open positions shown by solid member 28 in FIGS. 2 and 3 to the raised, closed positions shown by phantom member 28' in FIG. 3.

Air pressure within a segment 18 of the air mattress 10 exerts an upward force on the flap 34 of each valved gas outlet 20. Air pressure is represented by arrows A in FIG. 3. The air pressure seats the flap 34 against a lip 36 of the bottom ring 24. The hammer member 28 includes a downwardly extending projection 38 in contact with the upper surface of the flap 34. As the air pressure pivots the flap in the direction shown by arrow B, the pivoting is translated to the hammer member 28 by the projection 38. The raised position of the hammer member is illustrated by 28'.

In operation, the air pressure A exerts a force to bias the flap 34 into a position in which air cannot escape between the flap and the lip 36 of the bottom ring 24. Preferably, the flap 34 is similarly biased into the closed position by some other means, such as the hinged attachment of the flap to the bottom ring. This secondary bias may be provided by melt welding the flap to the bottom ring and using a material having a memory which urges the flap to the closed position.

With the flap 34 in the closed position, the hammer member 28 is at a level about the level of the top ring 22. Thus, a person reclining on the air mattress 10 will exert a force, represented by arrow C in FIG. 3, upon the hammer member 28'. The force C acts against the air pressure A to press the hammer member in the direction of arrow D. As a result, the flap 34 is brought to a gas-release position wherein air is allowed to escape between the flap and the bottom ring 24. The hammer member 28 rests against the lip 36 at the forward end of the lip, but the lip and hammer member are constructed to allow air passage to the annular gap 40 of FIG. 2. Alternatively, the hammer member 38 may include an array of passageways to the upper surface of the hammer member to allow air flow therethrough. The air flow supports and conditions the person resting upon the air mattress.

Figure 4:
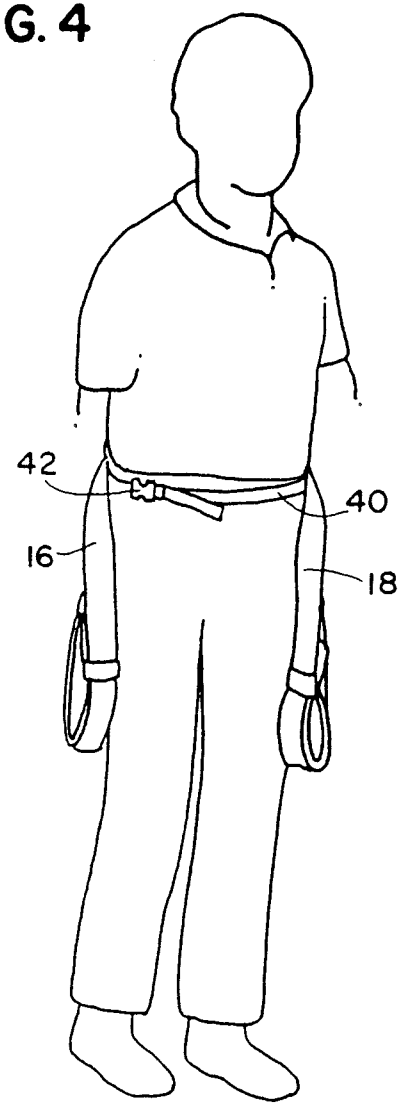
FIG. 4 is a side sectional view of a second embodiment of a valve for an air mattress in accord with the present invention.

FIG. 4 shows a second embodiment of the present invention. As in the above-described embodiment, the second embodiment includes a top ring 42 and a bottom ring 44 which are fixed to the upper wall 14 of a mattress by flathead screws 46. Here, however the flap 48 which selectively seals the air flow through an orifice has an upper surface which includes the shape of a truncated cone 50. Air pressure, as indicated by arrows E, biases the flap into flow-obstruction relationship with a lip 52 of the top ring 42. The weight of a person overcomes the bias to allow air flow between the bottom ring 44 and the flap 48.

Figure 5:
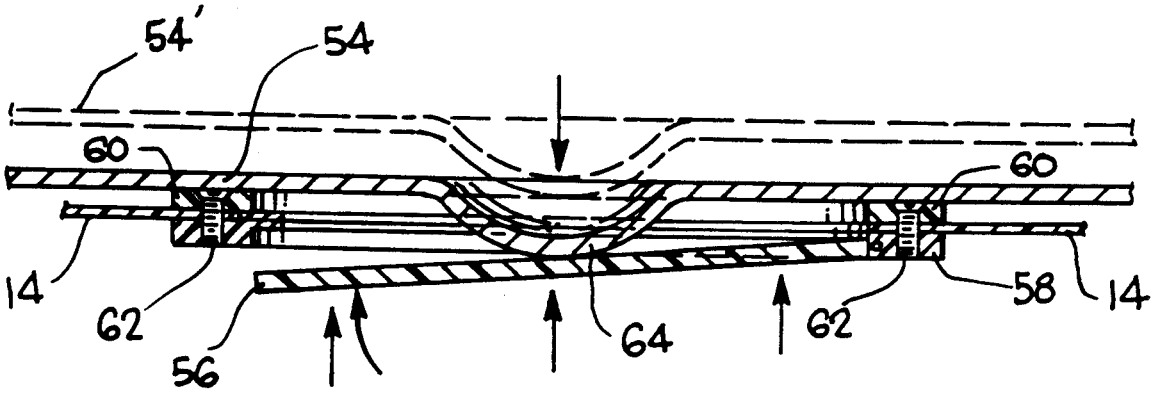
FIG. 5 is a side sectional view of a third embodiment of a valve for an air mattress in accord with the present invention.

The embodiment of FIG. 5 is operationally equivalent to the two embodiments described above, but does not include a hammer member or a projection which extends upwardly from a flap. Instead, a cover member 54 which is typically unattached to the air mattress includes the projections which are in motion-transfer relation with a flap 56. The flap 56 and a bottom ring 58 are identical to the ones described with reference to FIG. 3. The embodiment of FIG. 5 includes a top ring 60 secured to the bottom ring by flathead screws 62. In operation, the air mattress is inflated by a supply of gas, not shown. The flap 56 is biased into a closed position by air pressure. A user may place the cover member 54 atop the upper surface 14 of the air mattress. The cover member includes an array of nodules 64 which come into contact with the flaps 56. The cover member is made up of material which is not sufficiently dense to provide a gravitational force to overcome the bias of the flap into the closed position. The air pressure within the air mattress instead holds the cover member in the lifted condition represented by 54'. However, a person resting upon the cover member presses the flap and the cover member into the open position of FIG. 5. In this position, air is allowed to escape between the flap and the bottom ring 58. The cover member may be made of a material or in a manner to allow air flow through the cover member. Whether air flows through the cover member or is required to escape along the sides of the air mattress, the embodiment of FIG. 5 provides air support of the occupant.

While the present invention has been described and illustrated as having circular flaps, this is not critical. The flaps may be oval or square in shape, or may be of any other configuration which seals an orifice when brought into contact with the structure about the orifice. Likewise, it is not critical that the orifices have a circular configuration.

I claim:

1. A body support device comprising, a balloon-like support member having a gas inlet and having an upper wall having a plurality of gas outlets in fluid communication with said gas inlet, a plurality of valves, each coupled to said upper wall of said support member at a hinged region, each valve including a seal resiliently biased into a closed position in flow-obstruction relation with one of said gas outlets, each seal having a gas-release position, and a plurality of vertically displaceable members, each extending to a level with respect to said upper wall such that a force applied to said upper wall about a valve operatively associated with said displaceable member urges said displaceable member downward, said displaceable members being substantially mutually independent with respect to vertical displacement but each being in motion-transfer engagement with one of said seals to independently move said seal into said gas-release position upon downward movement of said displaceable member.

2. The device of claim 1 wherein said displaceable members have portions extending above the level of said upper wall of said support member.

3. The device of claim 1 wherein said displaceable members are hammers, having first ends pivotally coupled to said upper wall and having projections in contact with said seals.

4. The device of claim 1 wherein said seals are flaps biased by air pressure within said support member to obstruct said gas outlets.

5. The device of claim 4 wherein said flaps are generally circular and are attached to said upper wall at a peripheral region to pivot at said peripheral region.

6. The device of claim 1 wherein each seal combines with a displaceable member to form a unitary body, said displaceable member being a projection extending upwardly from said seal.

7. The device of claim 1 wherein said displaceable members are nodules on a cover member, said nodules extending downwardly from said cover member, said cover member being selectively positioned atop said support member.

8. The device of claim 1 wherein said support member is a mattress.

9. A body support device comprising, an inflatable member having a plurality of orifices in an upper wall thereof, a plurality of reciprocating flaps attached to said inflatable member at pivot joints, each flap having a gas-release position and having a closed position in which said flap is disposed to block gas flow through an orifice, said pivot joints being at a lower surface of said upper wall such that inflation of said inflatable member biases said flap in said closed position, and a plurality of projections operatively associated with said flaps to control the release of gas through said orifices, said projections having an upper extent above the level of said upper wall so that body weight applied to a projection counteracts said bias of an associated flap to move said flap into said gas-release position.

10. The device of claim 9 wherein said projections are substantially mutually independent with respect to vertical displacement.

11. The device of claim 9 wherein each flap has a generally circular configuration attached to said lower surface along a portion of the periphery of said flap.

12. The device of claim 11 wherein said projections are upwardly extending regions of said flaps.

13. The device of claim 9 wherein said projections are hammers, each having a first end pivotally attached to said upper surface and having a second end in contact with one of said flaps.

14. The device of claim 9 further comprising a cover member selectively positioned on said upper surface, said projections being nodules extending downwardly from said cover member for contact with said flaps.

15. A body support device of the type having means for receiving a supply of pressurized air and having a plurality of orifices in an upper wall thereof for the release of pressurized gas, the improvement comprising, a plurality of flaps, each flap pivotally connected to a lower surface of said upper wall and being made up of material having a memory to bias said flap into a closed position blocking gas flow through one of said orifices, and a plurality of hammer members having fixed ends attached to said upper wall and having cantilevered ends in contact with one of said flaps, each cantilevered end having a rest position extending to a level with respect to said upper wall such that a mass in contact with said upper wall about said cantilevered end applies a gravitational force to said cantilevered end, each cantilevered end having a displaced position wherein said force overcomes said bias of a flap to allow gas flow through one of said orifices.

16. The device of claim 15 wherein said hammer members are an elastic material.

17. The device of claim 15 wherein said body support device is an air mattress.

* * * * *

UNITED STATES PATENT AND TRADEMARK OFFICE

CERTIFICATE OF CORRECTION

PATENT NO. : 5,001,793

DATED : March 26, 1991

INVENTOR(S) : Yiu-Ching Liu

It is certified that error appears in the above-identified patent and that said Letters Patent is hereby corrected as shown below:

Drawings, Sheet 1 of 3 should be deleted.

Drawings, "Sheet 2 of 3" should read - -Sheet 1 of 2- -.

Drawings, "Sheet 3 of 3" should read - -Sheet 2 of 2- -.

Column 2, lines 46-47, "associated orifice, In a" should read - -associated orifice. In a- -.

Column 2, line 59, "upper walla bout" should read - -upper wall about- -.

Column 4, line 21, "ring maY be part" should read - -ring may be part- -.

Column 4, line 21, "of a unitary bodY" should read - -of a unitary body- -.

Signed and Sealed this

Twenty-eighth Day of July, 1992

*Attest:*

DOUGLAS B. COMER

*Attesting Officer*

*Acting Commissioner of Patents and Trademarks*